US007405707B2

(12) United States Patent
Murofushi et al.

(10) Patent No.: US 7,405,707 B2
(45) Date of Patent: Jul. 29, 2008

(54) COMPOSITE ANTENNA

(75) Inventors: Nobuo Murofushi, Shizuoka-Ken (JP); Kouichi Sano, Shizuoka-Ken (JP); Yasuhito Kiji, Shizuoka-Ken (JP); Yasuo Matsumoto, Shizuoka-Ken (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 20 days.

(21) Appl. No.: 11/465,293

(22) Filed: Aug. 17, 2006

(65) Prior Publication Data

US 2007/0046544 A1 Mar. 1, 2007

(30) Foreign Application Priority Data

Aug. 25, 2005 (JP) ..... 2005-244301

(51) Int. Cl.
*H01Q 21/00* (2006.01)
*H01Q 1/38* (2006.01)

(52) U.S. Cl. ..... 343/725; 343/700 MS; 343/895

(58) Field of Classification Search ..... 343/700 MS, 343/725, 895

See application file for complete search history.

(56) References Cited

U.S. PATENT DOCUMENTS

| | | | | |
|---|---|---|---|---|
| 5,598,168 | A | 1/1997 | Evans et al. | |
| 5,767,808 | A | 6/1998 | Robbins et al. | |
| 6,891,508 | B2 * | 5/2005 | Inoue | 343/725 |
| 6,927,737 | B2 * | 8/2005 | Inoue | 343/727 |
| 6,992,634 | B2 * | 1/2006 | Hashidate et al. | 343/700 MS |
| 2005/0104789 | A1 | 5/2005 | Hashidate et al. | |

FOREIGN PATENT DOCUMENTS

| | | |
|---|---|---|
| EP | 1 450 438 | 11/2002 |
| EP | 1 478 051 | 11/2004 |
| GB | 2 272 575 | 11/1992 |
| JP | 07-038328 | 2/1995 |
| JP | 07-094933 | 4/1995 |
| JP | 2001-102849 | 4/2001 |
| JP | 2003-152445 | 5/2003 |
| JP | 2004-102651 | 4/2004 |
| JP | 2007-028002 | 2/2007 |
| WO | WO 96/35241 | 11/1996 |

OTHER PUBLICATIONS

Japanese Office Action issued in corresponding foreign application No. JP 2005-244301, dated Aug. 21, 2007, accompanied by an English language translation.

* cited by examiner

*Primary Examiner*—Hoang V Nguyen
(74) *Attorney, Agent, or Firm*—DLA Piper US LLP

(57) ABSTRACT

A composite antenna includes a first antenna structure and a second antenna structure integrally combined with the first antenna structure to operate under different frequency bands respectively that are used in different radio transmission systems such that the first antenna structure has a first conductive layer to operate under a first frequency band and the second antenna structure has a second conductive layer a thickness of which is thicker than that of the first conductive layer to operate under a second frequency band lower than the first frequency band.

19 Claims, 4 Drawing Sheets

COMPOSITE ANTENNA

BACKGROUND OF THE INVENTION

1. Field of the Invention

The present invention relates, in general, to an antenna used in a radio communication. In particular, the invention relates to a composite antenna which can operable under a plurality of different frequency bands.

2. Description of the Related Art

Japanese laid-open patent application P2003-152445 discloses a conventional composite antenna which can operate under a plurality of different frequency bands. In this prior art, a circular polarized loop antenna structure for for 1.5 GHz band is formed on a dielectric substrate and a square patch antenna structure for 5.8 GHz band is also formed on the same substrate such that the patch antenna locates on the axis of the circular polarized loop antenna structure.

In recent years, an RFID (Radio Frequency Identification) system has been well known as one of the automatic identification technologies that utilize radio waves. The RFID system includes an interrogator (Reader/Writer) and a transponder (RFID tag) and a radio communication is carried out therebetween. When carrying out the radio communication, several transmission systems are used. One may be an electromagnetic coupling transmission that uses a mutual induction of coils caused by an alternating electromagnetic field. Another may be an electromagnetic induction transmission that uses a frequency below 135 kHz band or 13.56 MHz band. Still another may be a radio-wave transmission that uses a UHF band between 860 MHz and 960 MHz or 2.45 GHz band.

In particular, the electromagnetic induction transmission that utilizes 13.56 MHz band is used in a non-contact IC card system that is one of the applications of RFID system, and is widely adopted in many countries. The radio-wave transmission which utilizes a UHF band between 860 MHz and 960 MHz is approved to be used in European countries and the U.S.A, on the one hand, but is not approved in the RFID system in Japan, on the other hand.

Recently, a practical action has started in Japan to adopt a frequency band between 950 MHz and 956 MHz in RFID system and therefore development of a composite antenna that can be operable under not only 13.56 MHz band but also a frequency band between 950 MHz and 956 MHz is desired. That is, an RFID system that can be adapted to two different frequency bands has not been provided although such frequency bands are usable.

SUMMARY OF THE INVENTION

Accordingly, it is an object of the present invention to enable a composite antenna to be adapted to two different frequency bands that are used in different radio transmission systems.

To accomplish the above-described object, a composite antenna includes a first conductive layer, a first antenna structure, including the first conductive layer, which operates under a first frequency band, a second conductive layer whose thickness is thicker than that of the first conductive layer, a second antenna structure, including the second conductive layer, which operates under a second frequency band lower than the first frequency band, the second antenna structure being provided with the first antenna structure as a one piece.

BRIEF DESCRIPTION OF THE DRAWINGS

These and other objects and advantages of this invention will become apparent and more readily appreciated from the following detailed description of the presently preferred exemplary embodiments of the invention taken in conjunction with the accompanying drawings wherein.

DETAILED DESCRIPTION OF THE INVENTION

Figure 1:
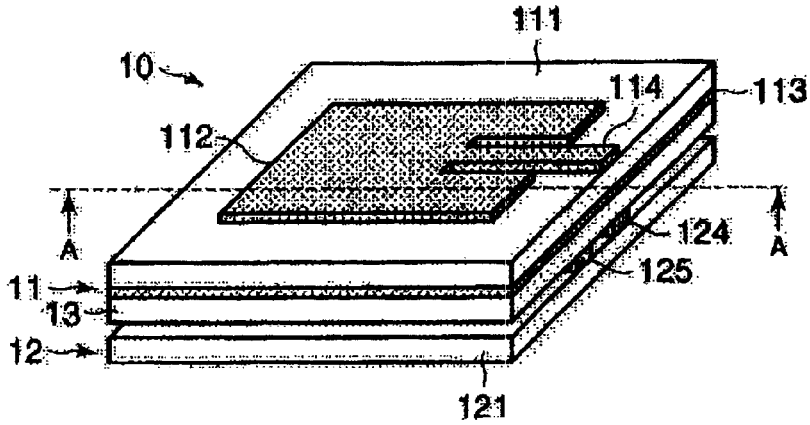
FIG. 1 is a perspective view illustrating an external appearance of a composite antenna of one embodiment according to the present invention.

Preferred embodiments of the present invention will now be described in more detail with reference to the accompanying drawings. However, the same numerals are applied to the similar elements in the drawings, and therefore, the detailed descriptions thereof are not repeated.

First Embodiment

Figure 2:
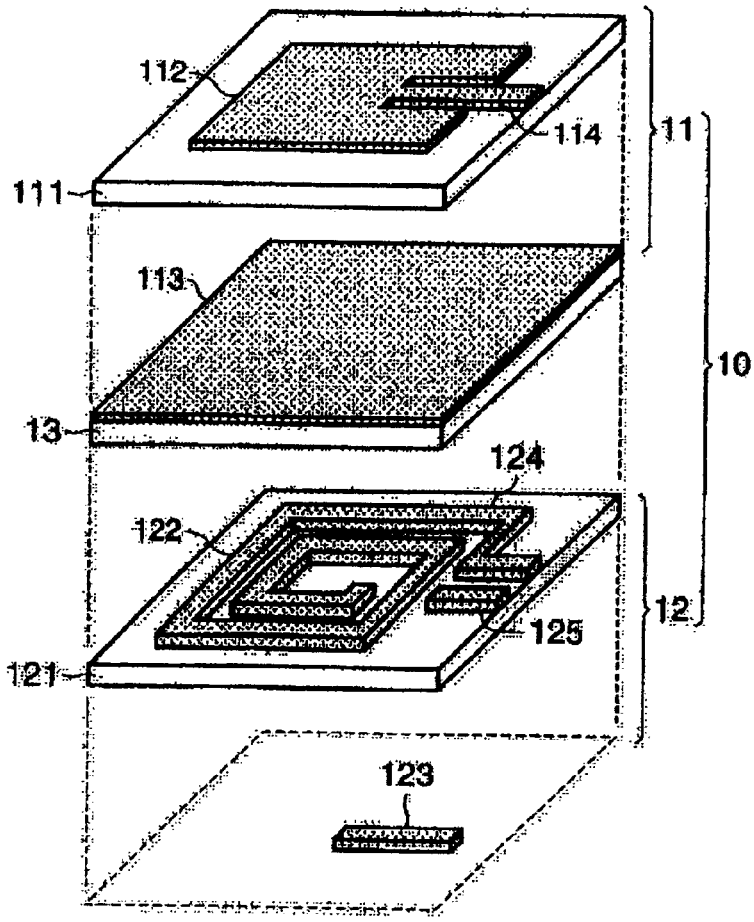
FIG. 2 is an exploded perspective view illustrating the composite antenna shown in FIG. 1.
Figure 3:
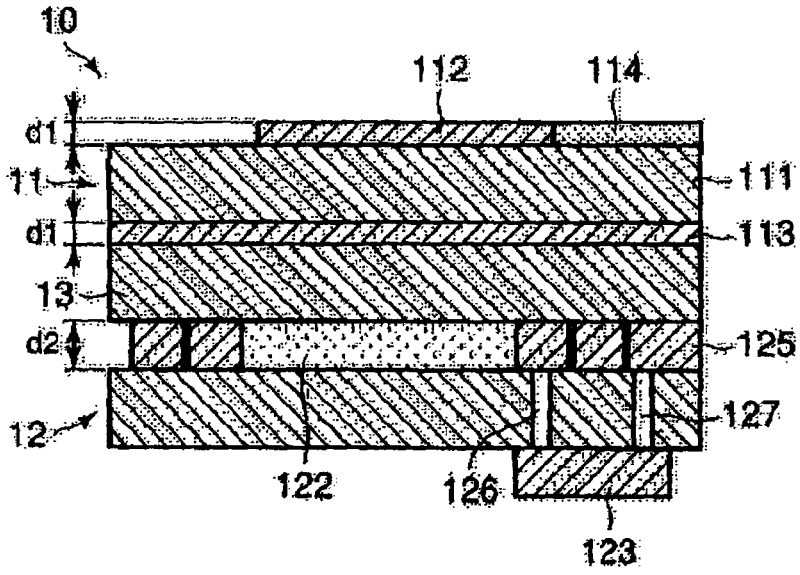
FIG. 3 is a vertical sectional view of the composite antenna taken along a line A-A in FIG. 1.

A first embodiment of the present invention will now be described with reference to FIGS. 1 to 4. FIG. 1 is a perspective view indicating the external appearance of a composite antenna 10. FIG. 2 is an exploded perspective view indicating the composite antenna 10 and FIG. 3 is a vertical sectional view of the composite antenna taken along a line A-A in FIG. 1.

As shown in FIGS. 1 and 2, the composite antenna 10 includes a first antenna structure 11 used in a radio-wave transmission in which energies or signals are transmitted through electromagnetic waves, acting as a power/data transmission medium, radiated in a space, as a first frequency band, and a second antenna structure 12 used in an electromagnetic induction transmission in which energies or signals are transmitted through an electromagnetic field, acting as a power/data transmission medium, generated around coils, as a second frequency band. The second frequency band is lower than the first frequency band and is apart from the first frequency band by a prescribed frequency band.

The first antenna structure 11 conducts a transmission/reception operation under 950 MHz (first frequency band) and the second antenna structure 12 conducts a transmission/reception operation under 13.56 MHz (second frequency band), for example. The first and second antenna structures 11 and 12 are integrally laminated such that a support substrate 13 made of a dielectric material is sandwiched therebetween.

The first antenna structure 11 is composed of a first dielectric substrate 111, a radiant conductor (patch electrode) 112 arranged on one of the surfaces of the first dielectric substrate 111 and an earth conductor (ground) 113 located at the other surface of the first dielectric substrate 111. The radiant conductor 112 and the earth conductor 113 constitute a first conductive layer.

The second antenna structure 12 is composed of a second dielectric substrate 121, a coiled conductor pattern 122 arranged on one of the surfaces of the second dielectric substrate 121 and a bar-shaped conductor pattern 123 arranged on the other surface of the second dielectric substrate 121. The coiled conductor pattern 122 and the bar-shaped conductor pattern 123 constitute a second conductive layer. The first; dielectric substrate 111, the second dielectric substrate 121 and the support substrate 13 each has a same size and is formed in a rectangular shape, respectively.

In the first antenna structure 11, the earth conductor 113 has the same size in an area as the first dielectric substrate 111 and is formed in a rectangular shape of a conductor pattern arranged on the support substrate 13. The radiant conductor 112 has a size in an area smaller than the first dielectric substrate 111 and is formed in a substantially rectangular shape of a conductor pattern. The radiant conductor 112 is arranged at a center of the first dielectric substrate 111. A center portion of one of the sides of the radiant conductor 112 is cut in a U-shape and a conductor pattern 114 extends toward the corresponding side of the dielectric substrate 111 from the bottom of the U-shaped portion.

The conductor pattern 114 functions as a feeder to supply power to the radiant conductor 112. Although a connecting structure is not shown, a core-wire of one of the ends of a coaxial cable is connected to the conductor pattern 114 and an outer-wire of the one end thereof is connected to the earth conductor 113, the other end of the coaxial cable being connected to a wireless communication device, which performs a radio communication using a radio-wave transmission. Thus, the first antenna structure 11 can be used to conduct a transmission/reception operation under the first frequency band that is used in the radio-wave transmission.

Figure 4A:
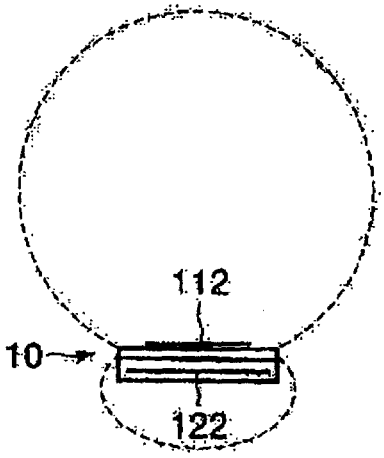
FIGS. 4*a* and 4*b* are schematic views respectively illustrating the directivity of a first antenna structure and the electromagnetic field distribution of a second antenna structure of the composite antenna shown in FIG. 1.

A directional intensity of the first antenna structure 11 is shown in FIG. 4*a*. As can be seen in the FIGURE, the first antenna structure 11 has an intensive directivity toward a side that the radiant conductor 112 is provided, in comparison with a direction orthogonal to the side. In other words, the first antenna structure 11 has Ea characteristic in which it intensively radiates radio waves toward the side that the radiant conductor 112 is provided. Therefore, the first antenna structure 11 functions as a planer patch antenna that can operate effectively under the electromagnetic field of radio waves.

In the second antenna structure 12, the coiled conductor pattern 122 includes a rectangular voluted pattern portion 124 and a straight pattern portion 125 arranged on the front surface of the second dielectric substrate 121. One of the ends (starting tip) of the voluted pattern portion 124 locates at one of the sides of the second dielectric substrate 121 and the other end (trailing tip) thereof locates at a substantially center of the second dielectric substrate 121. One of the ends of the straight pattern portion 125 locates at the one side of the second dielectric substrate 121 at which the starting tip of the voluted pattern portion 124 locates and the other end thereof straightly extends in the vicinity of the voluted pattern portion 124. The other end of the straight pattern portion 125 is not overlapped with the voluted pattern portion 124, as shown in FIG. 2.

The bar-shaped conductor pattern 123 locates on the rear surface of the second dielectric substrate 121 such that one of the ends of the bar-shaped conductor pattern 123 is overlapped with the trailing tip of the voluted pattern portion 124 and the other end thereof is overlapped with the other end of the straight pattern portion 125 in front and rear surfaces of the second dielectric substrate 121.

A first through hole 126 is provided at a portion of the second dielectric substrate 121 that the trailing tip of the voluted pattern portion 124 and the one of the ends of the bar-shaped conductor pattern 123 are overlapped. A second through hole 127 is also provided at a portion of the second dielectric substrate 121 that the other end of the straight pattern portion 125 and the other end of the bar-shaped conductor pattern 123 are overlapped different from the portion the first through hole 126 is provided.

The starting tip of the voluted pattern portion 124 that locates at the one of the sides of the second dielectric substrate 121 and one of the ends of the straight pattern portion 125 function as a feeder to feed power to the coiled conductor pattern 122. That is, as being not shown, a core-wire of one of the ends of a coaxial cable is connected to the one of the ends of the voluted pattern portion 124 and an outer-wire of the one end thereof is connected to the one of the ends of the straight pattern portion 125, the other end of the coaxial cable being connected to a wireless communication device, which performs a radio communication using an electromagnetic induction transmission.

A current input from the coaxial cable to the starting tip of the voluted pattern portion 124 flows through the voluted pattern portion 124 and is input from the trailing tip thereof to the one of the ends of the bar-shaped conductor pattern 123 through the first through hole 126. The current input to the one end of the bar-shaped conductor pattern 123 flows through the conductor pattern 123 and input from the other end thereof to the other end of the straight pattern portion 125; through the second through hole 127. The current input to the other end of the straight pattern portion 125 is output to the coaxial cable from the one end thereof through the straight pattern portion 125. A current input from the coaxial cable to the one end of the straight pattern portion 125 flows in a direction opposite to the above and is output from the starting tip of the voluted pattern portion 124 to the coaxial cable. By this way, the second antenna structure 12 performs a transmission/reception operation under the second frequency band that is used in the electromagnetic induction transmission.

Figure 4B:
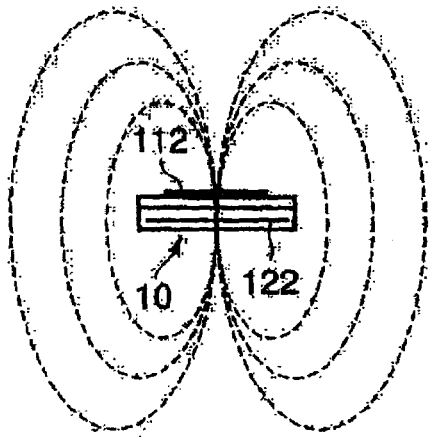

A magnetic field distribution of the second antenna structure 12 is shown in FIG. 4*b*. In the FIGURE, dotted line indicates a magnetic flux and a portion that magnetic flux concentrates is of a high magnetic flux density. As is shown, there are high magnetic flux density portions at a center of the coiled conductor pattern 122 in a direction perpendicular to the conductor pattern 122 that constitutes the second antenna structure 12. A high communication characteristic can be achieved when a communication is carried out at the portions the magnetic flux density is high. The second antenna structure 12 functions as a coiled antenna which performs an effective operation against the magnetic field of radio-waves.

In this embodiment, a thickness of the conductive layer forming the first antenna structure 11, i.e., a thickness d1 of the radiant conductor 112 and the earth conductor 113 is thinner than that of the conductive layer forming the second antenna structure 12, i.e., a thickness d2 of the coiled conductor pattern 122. It should be noted that a thickness of the radiant conductor 112 may be different from that of the earth conductor 113 if both thicknesses (d1) are thinner than that (d2) of the coiled conductor pattern 122.

In general, a current flowing through a conductor only flows along an area near the surface of the conductor as a frequency thereof becomes high. This phenomena is called as a Skin Effect and a skin-depth (δ) that current flows is shown in the following formula (1):

$$\delta = \sqrt{\frac{2}{\omega\mu\sigma}} \quad (1)$$

wherein ω is 2πf, f is a frequency, μ is a permeability and σ is a conductivity.

In case that a conductor is made of copper, for example, conductivity (σ) thereof is $58\times10^6$ (S/m). Since permeability (μ) of copper is $4\pi\times10^{-7}$, a skin-depth (δ) is 18 μm when a frequency is 13.56 MHz that is used in an electromagnetic induction transmission. On the other hand, a skin-depth (δ) is 2 μm when a frequency is 950 MHz that is used in a radio-wave transmission. From the above formula (1), each thickness of the conductive layers of the first and second antenna structures may be determined in proportion to a value that is obtained by raising a frequency (f) used for a specific communication to the (−½) power if materials of conductive layers of the first and second antenna structures are the same.

Therefore, if a thickness of the copper-foil of an antenna operating under 950 MHz band is set to 2 μm on the one hand, a power-loss of the copper-foil pattern can be decreased, and a thickness of the copper-foil of an antenna operating under 13.56 MHz is set to be greater than 18 μm on the other hand, a power-loss of the copper-foil pattern can also be decreased. If a copper-foil whose thickness is greater than 18 μm locates, electromagnetic waves of 13.56 MHz band are not almost transmitted in other words, when the thickness of the copper-foil is less than 18 μm, electromagnetic waves of 13.56 MHz can be passed through the copper-foil and the thinner the thickness of the copper-foil the greater the passing amount of the electromagnetic waves.

Based on the above, in the embodiment, the first frequency band that is used in the radio-wave transmission is set to 950 MHz, and the thickness d1 of the conductive layer of the first antenna structure 11 operating under 950 MHz is set to between 2 μm and 18 μm. Furthermore, the second frequency band used in the electromagnetic induction transmission is set to 13.56 MHz and the thickness d2 of the conductive layer of the second antenna structure 12 operating under 13.56 MHz is set to be greater than 18 μm.

In the composite antenna 10 of the above construction, since the second antenna structure 12 is provided at an outside of a side at which the radiant conductor 112 locates, radio-waves intensively radiated to the side that the radiant conductor 112 locates within radio-waves radiated from the first antenna structure 11 are not adversely affected by the second antenna structure 12. In addition, since the thickness of the conductive layer which forms the first antenna structure 11 is less than 18 μm, an attenuating amount of electromagnetic waves radiated from the second antenna structure 12 is small.

Therefore, according to the embodiment described above, a stable radio-communication can be performed using either the first antenna structure 11 under the first frequency band, on the one hand, that is used in a radio-wave transmission or the second antenna structure 12 under the second frequency band, on the other hand, that is used in an electromagnetic induction transmission. It can provide a small sized composite antenna 10 that can be usable in two different frequency bands, such as, e.g., 950 MHz, 13.56 MHz, respectively used in the radio-wave transmission and the electromagnetic induction transmission.

Second Embodiment

Figure 5:
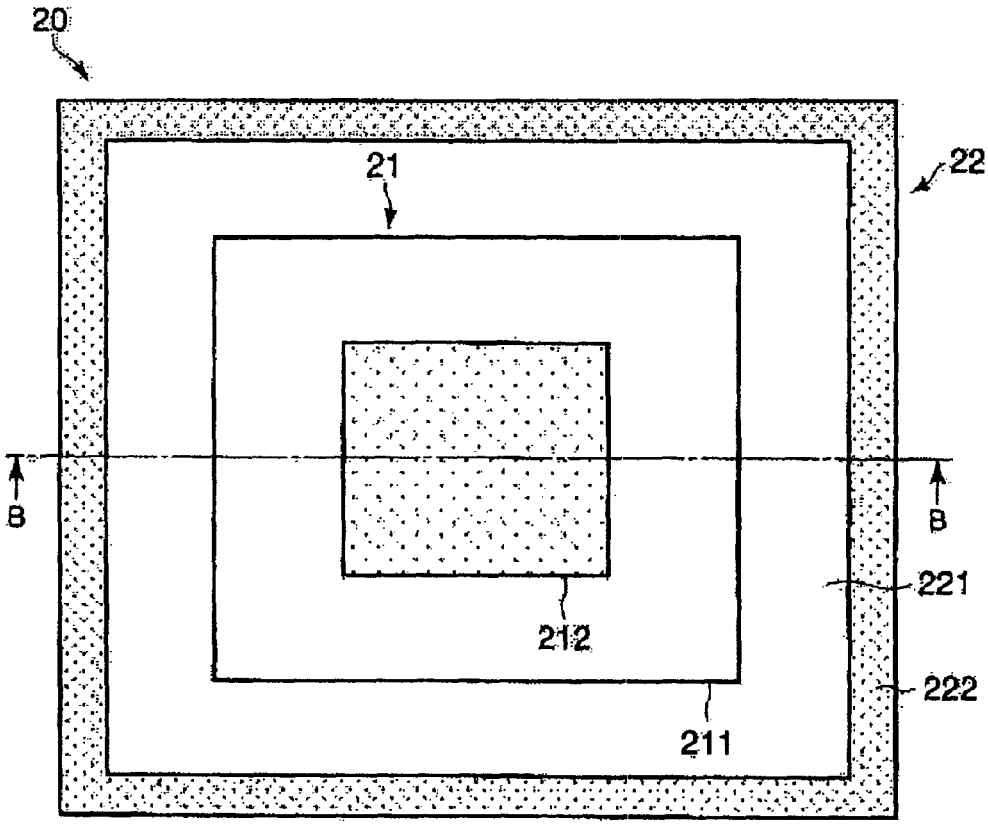
FIG. 5 is a plan view illustrating a composite antenna of a second embodiment shown from the above.
Figure 6:
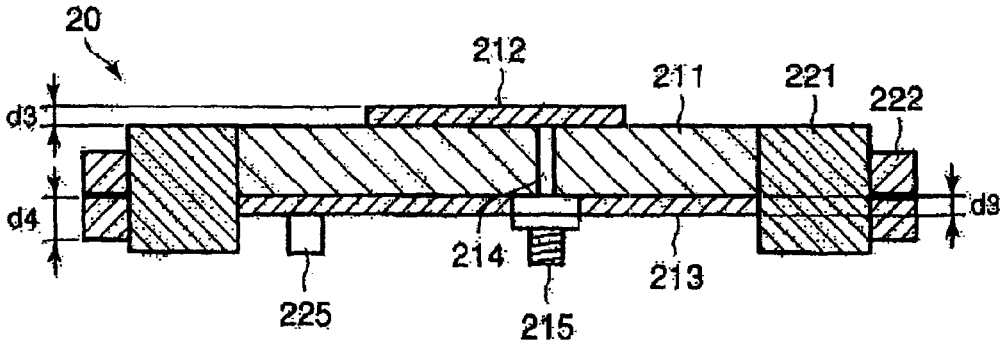
FIG. 6 is a vertical sectional view illustrating the composite antenna taken along a line B-B in FIG. 5.
Figure 7:
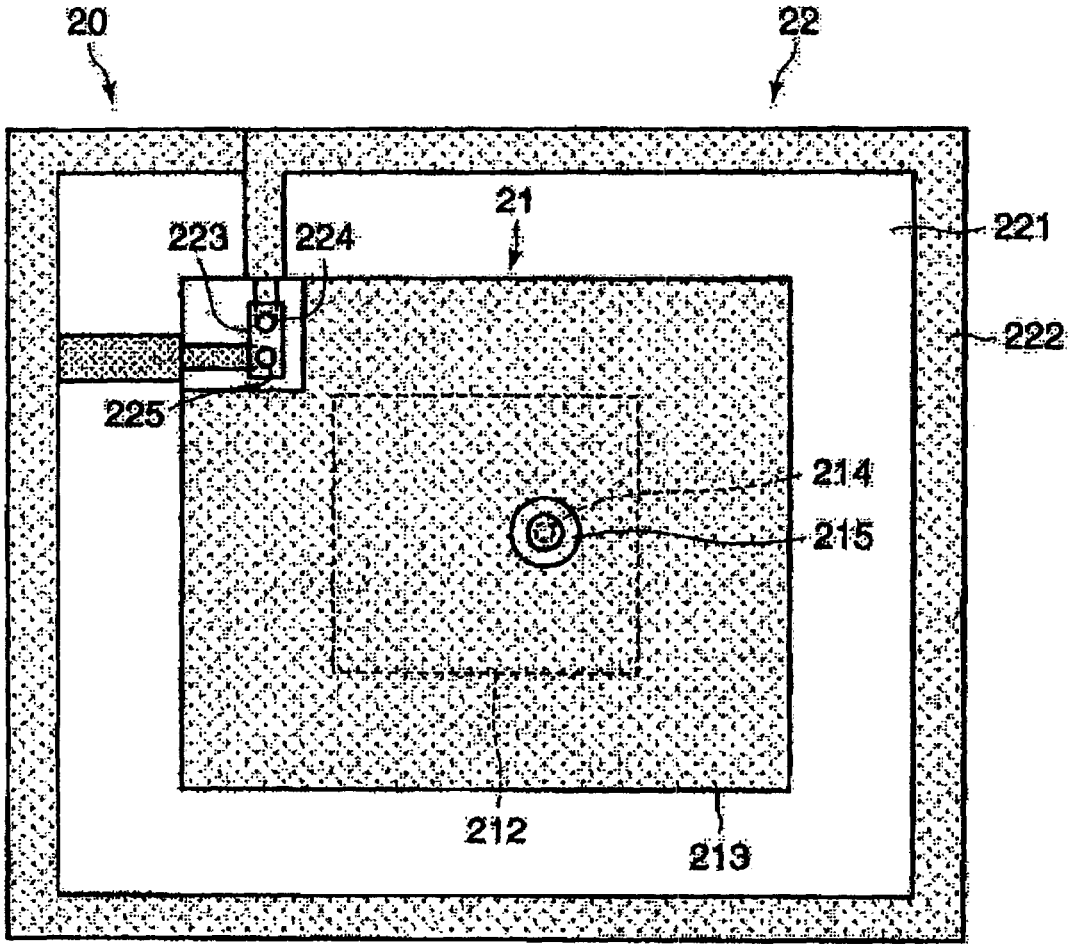
FIG. 7 is a plan view illustrating the composite antenna of the second embodiment shown from the blow.

A composite antenna 20 of a second embodiment of the present invention will be described with reference to FIGS. 5 to 7. FIG. 5 is a plan view of a composite antenna 20 shown from the front surface side, FIG. 6 is a vertical sectional view of the composite antenna taken along a line B-B in FIG. 5, and FIG. 7 is a plan view of the composite antenna shown from the rear surface side.

The composite antenna 20 is also provided with a first antenna structure 21 that operates a transmission/reception under 950 MHz, for example, as a first frequency band used in a radio-wave transmission and a second antenna structure 22 that operates a transmission/reception under 13.56 MHz, for example, as a second frequency band used in an electromagnetic induction transmission. The second frequency band is lower than the first frequency band and the first: and second frequency bands are set a prescribed frequency band apart. The first antenna structure 21 and second antenna structure 22 are integrated such that the second antenna structure 22 is provided to the outer circumference of the first antenna structure 21. A radiation gain of the first antenna structure 21 in a direction toward the outer circumference thereof is small in comparison with that in an orthogonal direction thereof.

The first antenna structure 21 is composed of a dielectric substrate 211, a radiant conductor (patch electrode) 212 located on one of the surfaces of the substrate 211, and an earth conductor (ground) 213 that is located on the other surface of the substrate 211. The radiant conductor 212 and the earth conductor 213 constitute a first conductive layer.

The second antenna structure 22 is composed of a support frame 221 made of a dielectric material that has a rectangular shaped opening and a conductor coil 222 of a copper wire that is wound around the outside of the support frame 221. The conductor coil 222 is a second conductive layer. The support frame 221 a function that the first antenna structure 21 is integrally supported.

In the first antenna structure 21, the earth conductor 213 has a substantially rectangular shaped conductor pattern whose area is the same as that of the dielectric substrate 211 and is located on the rear surface of the substrate 211. The radiant conductor 212 has a rectangular shaped conductor pattern whose area is smaller than that of the dielectric substrate 211 and is provided nearly at a center of the front surface of the substrate 211.

A through hole 214 is formed on the dielectric substrate 211 in the thickness direction thereof such that it is located at a portion on the dotted line indicated by line B-B at a ⅓ distance of the entire width of the radiant conductor 212 from the right side thereof. A location of the through hole 214 is determined based on the impedance of a radio communication device connected to the first antenna structure 21. A connector 215 is inserted into the through hole 214 from the side the earth conductor 213 locates. By this way, an inner conductor of the connector 215 is connected to the radiant conductor 212 and an outer conductor thereof is connected to the earth conductor 213.

By connecting a radio communication device which carries out a radio communication using a radio-wave transmission to the connector 215, the first antenna structure 21 performs a transmission/reception operation under the first frequency band. At this time, the first antenna structure 21 has a strong directivity toward a side that the radiant conductor 212 is provided, as similar to that shown in FIG. 4*a*. That is to say, a radiation gain at a side of the dielectric substrate 211 that the radiant conductor 212 is provided is high and a radiation gain in an outer circumferential direction parallel to the surface of the earth conductor 213 is low. The first antenna structure 21 functions as a planer patch antenna which effectively operates against an electric field of radio-waves.

In the second antenna structure 22, the rectangular shaped opening of the support frame 221 is firmly fitted to the outer circumference of the dielectric substrate 211 perpendicular to a surface of the earth conductor 213 in the first antenna structure 21 conductor coil 222 is wound around the outer surface of the support frame 221. As shown in FIG. 7, one of the ends of the conductor coil 222 is connected to one of the terminals 224 of a dual terminal connector 223 and the other end of the conductor coil 222 15 connected to the other terminal 225 of the dual terminal connector 223. The dual terminal connector 223 is provided to a cut area of the earth conductor 213 on the rear surface side of the dielectric 211.

Then, by connecting a radio communication device that carries out a radio communication using an electromagnetic induction transmission to the dual terminal connector 223, a current input from the one of the terminals 224 of the dual terminal connector 223 flows through the conductor coil 222 to be input to the other terminal 225 of the dual terminal connector 223 and a current input from the other terminal 225 flows through the conductor coil 222 in a reverse direction to be input to the one of the terminals 224. By this way, the second antenna structure 22 performs a transmission/reception operation under the second frequency band that is used in an electromagnetic induction transmission.

The magnetic field distribution of the second antenna structure 22 is similar to that shown in FIG. 4*b*. The flux density is high at a center of the conductor coil 222 in a direction perpendicular to the conductor coil 222. When tue communication operation is carried out in the portion where the flux density is high, a better communication characteristic can be achieved. The second antenna structure 22 functions as a coil shaped antenna that effectively operates against the magnetic field of radio waves.

In the second embodiment of the composite antenna 20 also constructed as described above, a conductive layer forming the first antenna structure 21, i.e., a thickness d3 of the radiant conductor 212 and the earth conductor 213, is thinner than a conductor layer forming the second antenna structure 22, i.e., a thickness d4 of the conductor coil 222, as similar to that of the first embodiment. In the concrete, the thickness d3 of the radiant conductor 212 and the earth conductor 213 is greater than a skin-depth (δ) at which a current of the first frequency band under which the first antenna structure 21 operates flows and is smaller than a skin-depth (δ) at which a current of the second frequency band under which the second antenna structure 22 operates flows. In addition, the thickness d4 of the conductor coil 222 is greater than a skin-depth (δ) at which a current of the second frequency band that the second antenna structure 22 operates flows.

In the above-described composite antenna, as similar to the first embodiment, since the second antenna structure 22 is provided at the outside of a side that the radiant conductor 212 is provided, an electromagnetic waves intensively radiated to the side that the radiant conductor 212 is provided within radio waves radiated from the first antenna structure 21 do not receive any influence by the second antenna structure 22. One the other hand, since the thickness of the conductive layer forming the first antenna structure 21 is less than 18 μm, an amount that an electromagnetic waves radiated from the second antenna structure 22 attenuate at a conductive layer of the first antenna structure 21 is small. Therefore, it can provide a small sized composite antenna 20 that can stably perform a radio communication using either the first antenna structure 21 under the first frequency band that is used in a radio-wave transmission or the second antenna structure 22 under the second frequency band that is used in an electromagnetic induction transmission.

The present invention is not limited to the above-described embodiments, and thus, a shape of composite antenna 10, 20 is not limited to a rectangular shape and may be formed in a circular shape or a polygonal shape, e.g., triangle, pentagon, hexagon and others.

In addition, the thickness d1, d3 of the conductive layer forming the first antenna structure 11, 21 may be a thickness that can restrain an influence by the second antenna structure 12, 22 and the thickness d2, d4 of the conductive layer forming the second antenna structure 12, 22 may be a thickness that can be used under the second frequency band. Furthermore, a material of the conductive layers is not limited to a copper.

The present invention has been described with respect to specific embodiments. However, other embodiments based on the principles of the present invention should be obvious to those of ordinary skill in the art. Such embodiments are intended to be covered by the claims.

What is claimed is:

1. A composite antenna comprising:

a first conductive layer having a first thickness;

a first antenna structure, including the first conductive layer, which is operable under a first frequency band;

a second conductive layer having a second thickness is thicker than the first thickness of the first conductive layer; and a second antenna structure, including the second conductive layer, which is operable under a second frequency band lower than the first frequency band, the second antenna structure being integrally provided with the first antenna structure, thereby causing electromagnetic waves having frequencies within the second frequency band to travel through the first antenna structure to the second antenna structure, the first thickness being smaller than the skin-depth of a current having a frequency within the second frequency band.

2. The antenna according to claim 1, wherein the first and second frequency bands are set a prescribed frequency band apart so that the first antenna structure is adapted to a radio-wave transmission and the second antenna structure is adapted to an electromagnetic induction transmission.

3. The antenna according to claim 1, wherein the first and second conductive layers are formed with a same material, respectively.

4. The antenna according to claim 3, wherein the first thickness associated with the first conductive layer and the second thickness associated with the second conductive layer are each proportional to a value obtained by raising a frequency (f) used for each of the first antenna structure and the second antenna structure to the (−½) power.

5. The antenna according to claim 1 further including a supporter made of a dielectric material, which integrally supports the first and second antenna structures.

6. The antenna according to claim 5, wherein the supporter is disposed between the first and second antenna structures.

7. The antenna according to claim 1, wherein the first and second antenna structures are different in shape from each other.

8. The antenna according to claim 7, wherein the first antenna structure is a patch antenna and the second antenna structure is a coiled antenna.

9. The antenna according to claim 8, wherein the first antenna structure includes a first dielectric substrate and an earth conductor provided on a surface of the first dielectric substrate, the first conductive layer being provided on the other surface of the first dielectric substrate.

10. The antenna according to claim 9, wherein the second antenna structure includes a second dielectric substrate and the second conductive layer is provided on one surface of the second dielectric substrate.

11. The antenna according to claim 1, wherein the second antenna structure includes a supporting frame made of a dielectric material provided on an outer circumference of the first antenna structure and a coiled conductor provided on an outer circumference of the supporting frame.

12. The antenna according to claim 11, wherein the first antenna structure includes a first dielectric substrate and an earth conductor provided on a surface of the first dielectric substrate, the first conductive layer being provided on another surface of the first dielectric substrate.

13. The antenna according to claim 12, wherein a radiation gain of the first antenna structure in a plane direction of the first dielectric substrate is less than the radiation gain in a direction normal to the first dielectric substrate.

14. The antenna according to claim 1, wherein the second conductive layer has a thickness greater than a skin-depth of a current having a frequency within the second frequency band.

15. A composite antenna comprising:

a first conductive layer having a first thickness;

first means including the first conductive layer for conducting a transmission/reception operation under a first frequency band;

a second conductive layer having a second thickness thicker than the first thickness of the first conductive layer; and second means including the second conductive layer for conducting a transmission/reception operation under a second frequency band lower than the first frequency band, the first means and the second means being integrally combined with one another, thereby causing electromagnetic waves having frequencies within the second frequency band to travel through the first means to the second means, the first thickness of the first conductive layer being smaller than the skin-depth of a current having a frequency within the second frequency band.

16. The antenna according to claim 15, wherein the first and second frequency bands are set a prescribed frequency band apart so that the first means is adapted to a radio-wave transmission and the second means is adapted to an electromagnetic induction transmission.

17. The antenna according to claim 15, wherein the first and second conductive layers are formed with a same material, respectively and the first thickness of the first conductive layer and the second thickness of the second conductive layer are each proportional to a value obtained by raising a frequency used for each of the first means and the second means to the $(-1/2)$ power.

18. The antenna according to claim 15 further including a supporting means made of a dielectric material for integrally supporting the first and second means.

19. A composite antenna comprising:

a first antenna structure, configured to operate within a first frequency band, the first antenna structure including a first substrate a radiant conductor on one surface of the first substrate, and an earth conductor on another surface of the first substrate, each thickness of the radiant conductor and the earth conductor being smaller than a skin-depth of a current having a frequency within a second frequency band lower than the first frequency band; and a second antenna structure integrated with the first antenna structure, the second antenna structure configured to operate within the second frequency band, the second antenna structure including a second substrate and a coiled conductor, the thickness of the coiled conductor being thicker than the skin-depth of a current having a frequency within the second frequency band.

* * * * *